United States Patent [19]

Stauffer

[11] Patent Number: 4,739,863

[45] Date of Patent: Apr. 26, 1988

[54] VAT WHEEL LOCK

[76] Inventor: Richard L. Stauffer, Box 180, Tunkhannock, Pa. 18657

[21] Appl. No.: 884,533

[22] Filed: Jul. 11, 1986

[51] Int. Cl.[4] ..... B61K 7/02

[52] U.S. Cl. ..... 188/32; 104/249; 104/252; 188/36; 188/62; 410/30

[58] Field of Search ..... 188/36, 37, 35, 32, 188/2 R, 62; 104/258, 250, 252, 249; 410/30

[56] References Cited

U.S. PATENT DOCUMENTS

| | | | |
|---|---|---|---|
| 1,100,184 | 6/1914 | Housman et al. | 104/252 |
| 1,115,382 | 10/1914 | Boltendahl | 104/252 |
| 2,175,286 | 10/1939 | Finch | 104/258 X |
| 4,080,904 | 3/1978 | Lofink et al. | 104/252 X |
| 4,480,723 | 11/1984 | Ingvast et al. | 188/62 |

FOREIGN PATENT DOCUMENTS

| | | | |
|---|---|---|---|
| 1080500 | 4/1960 | Fed. Rep. of Germany | 188/36 |
| 998732 | 7/1965 | United Kingdom | 104/252 |

*Primary Examiner*—George E. A. Halvosa
*Attorney, Agent, or Firm*—John Kurucz

[57] ABSTRACT

A locking assembly for vat wheels mounted in a track includes an air cylinder actuator having a reciprocating piston rod which drives a pivotable rocker assembly. The rocker assembly includes a pair of wheel braces which, in a locking position, cross the tracks contacting the inner surfaces of two adjacent vat wheels to prevent rolling or rocking of the vat.

7 Claims, 3 Drawing Sheets

VAT WHEEL LOCK

FIELD OF THE INVENTION

This invention pertains to locking systems and more particularly to a wheel locking assembly for trapping wheels of a vat in a track to prevent rolling or rocking thereof.

BACKGROUND OF THE INVENTION

Liquid collection and transfer operations are common to many industries. Typically large collection vats are used, often more than 100 cubic feet in volume. For transportation, vats are commonly mounted on tracks which, in turn, are typically mounted on an elevated platform. During filling of a vat, in order to prevent costly spillage, it is essential to keep the vat stationary. Due to the heavy weights involved, and the tendency of the liquids to rock back and forth, an efficient, reliable system for immobilizing a vat is essential.

Various systems for locking wheels exist in the prior art. U.S. Pat. No. 1,726,724 discloses a means for releasably locking wheels of a vehicle in a stall having a pivotably-mounted rocking member adapted for remote actuation. In a raised position the rocking member prevents a rear wheel of a vehicle from rolling. In a lowered position the rocking member releases the wheel, allowing the wheel to roll over it. U.S. Pat. No. 3,581,846 relates to a locking device for wheels of an automobile. This patent discloses a pair of blocks shaped as chocks joined together by a tie bar to fit under the forward and rearward portions of a vehicle wheel.

Another type of wheel lock involves inserting a stationary pin into a mating aperture of a wheel to prevent rotation of the wheel (see, e.g., U.S. Pat. No. 3,652,103).

As can be seen from the above, while a number of wheellocking systems have been developed, the prior art has not provided an efficient system for locking vat wheels in a track.

SUMMARY OF THE INVENTION

The primary object of the present invention is to provide an efficient locking assembly for trapping wheels of a vat in a track to prevent rolling.

Another object is to provide a simple locking system employing an air cylinder for convenient actuation.

A still further object is to provide a locking system having reliable locking action wherein wheel braces are wedged between inner or near surfaces of adjacent vat wheels within a track to provide sure locking against rocking or rolling of the vat.

The locking system of the present invention provides:

an air cylinder for actuating a rocker assembly having a cylinder portion and a piston rod, the piston rod being coupled to the pivotable locking assembly and the cylinder portion being mounted to a stationary mount. The rocker assembly contains a means for coupling to the piston rod, a pivot means mounted to a stationary mount, and a support means for supporting a pair of wheel braces. The wheel braces are mounted one on each side of the support means and pivotable with the locking assembly from a position spaced from the track to a position transverse to the track, blocking movement of wheels along the track.

DETAILED DESCRIPTION OF THE PREFERRED EMBODIMENT

Figure 1:
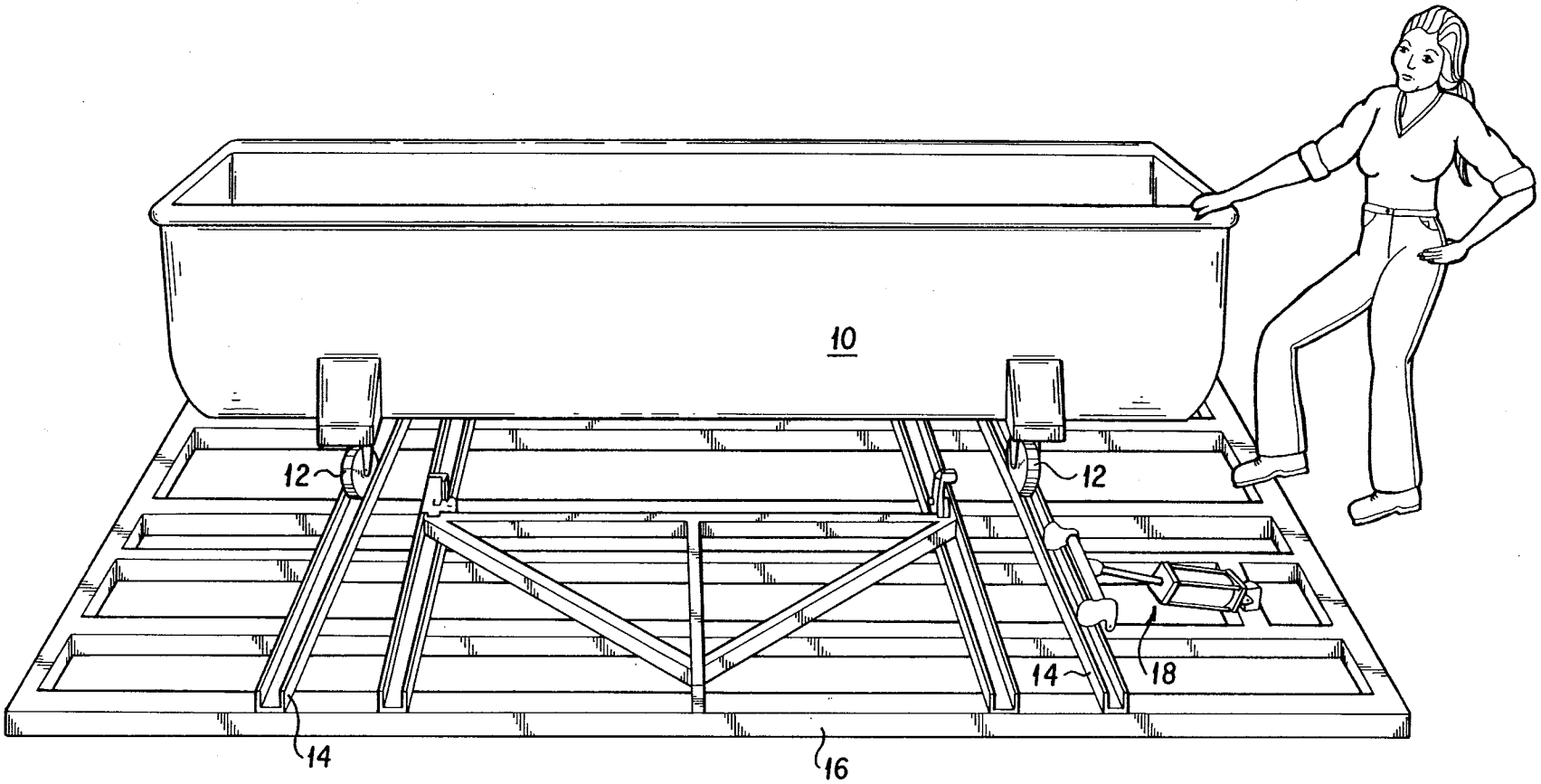
FIG. 1 is a perspective view of a vat having wheels mounted in a track, the track provided with the locking assembly of the present invention.

FIG. 1 illustrates a vat 10 having wheels 12 mounted in tracks 14. The tracks are mounted on an elevator 16. As is apparent from the drawing, the vat is a large industrial vat having four wheels, each wheel mounted within a narrow guide track. A locking assembly 18 is also shown.

Figure 2:
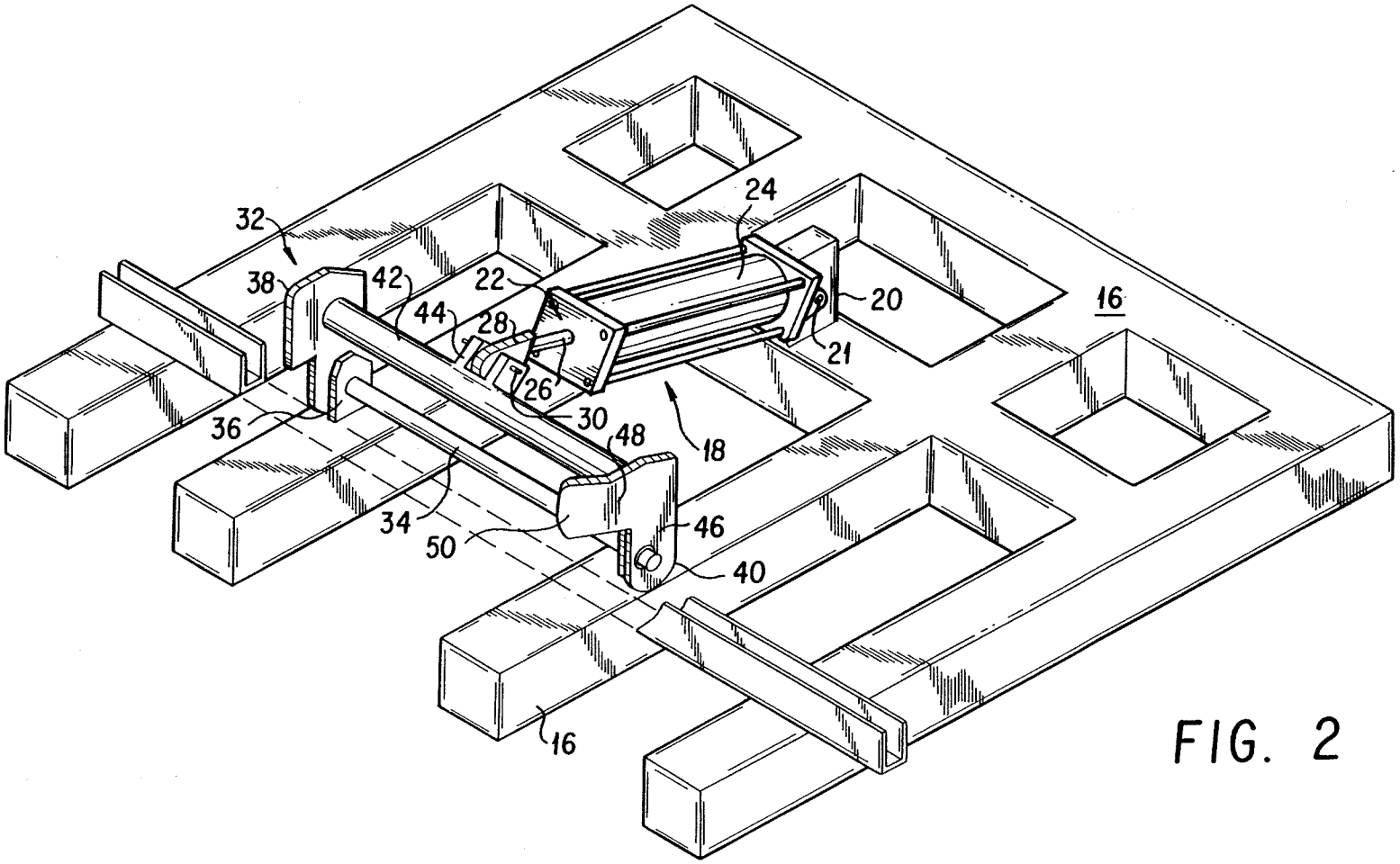
FIG. 2 is a close-up perspective view of the locking assembly of the present invention.

FIG. 2 provides a close-up view of locking assembly 18. A rear air cylinder mount 20 is firmly affixed to elevator 16 and has a pin 21 for rotatably mounting a cylinder housing 22. Fluid cylinder 24, preferably an air cylinder, is mounted within the cylinder housing. A piston rod 26 reciprocates within the air cylinder and extends therefrom. The air cylinder may be actuated in any conventional manner.

Piston rod 26 has a mounting piece 28 at a forward end having an aperture for receiving a mounting pin 30. The air cylinder is coupled to the rocker assembly 32 by mounting pin 30.

Rocker assembly 32 includes a pin 34 secured to elevator 16 by stationary pin mounts 36. The ends of pin 34 extend through apertures in wheel braces 38 and 40 to pivotally secure the wheel braces thereto. The wheel braces are maintained rotatably mounted to pin 34 by any suitable means such as a cotter pin inserted through the end of bar 34.

Figure 5:
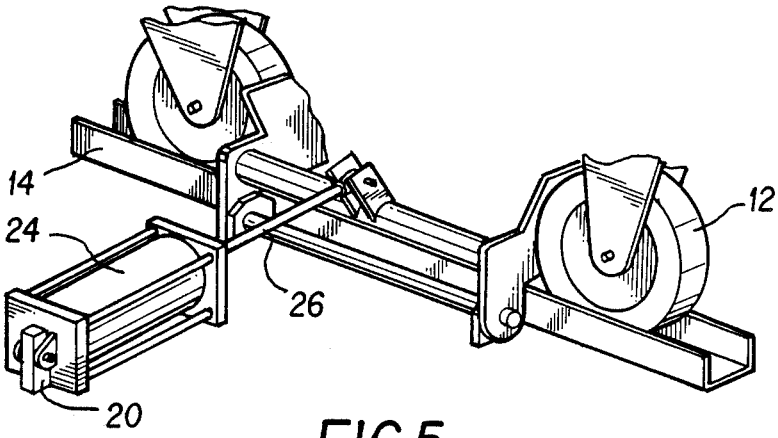
FIG. 5 is a perspective view of the device of FIG. 3.

In the embodiment of FIG. 2, each wheel brace comprises an L-shaped member having a first leg 46 which extends substantially vertically when the rocker assembly is in a raised position (as shown in FIG. 2) and a second leg 48 which extends substantially horizontally when the rocker is raised. Second leg 48 contains a forward portion 50 which inclines inwardly with respect to the support bar 42 so that during locking the wheel braces will act as a wedge between the inner surfaces of adjacent vat wheels to provide a sure block against rolling or rocking of the vat. The wheel braces are supported by the ends of a support bar 42 which has a predetermined length and is adapted to space the wheel braces a distance equal to the distance between the inner surfaces of a pair of vat wheels which are adjacent within a given track as shown in FIG. 5. Support bar 42 contains flanges 44 having apertures for passing mounting pin 30 therethrough. The wheel braces and support bar rotate about pivot bar 34 in accordance with the reciprocatory motion of piston rod 26 of air cylinder 24.

Figure 3:
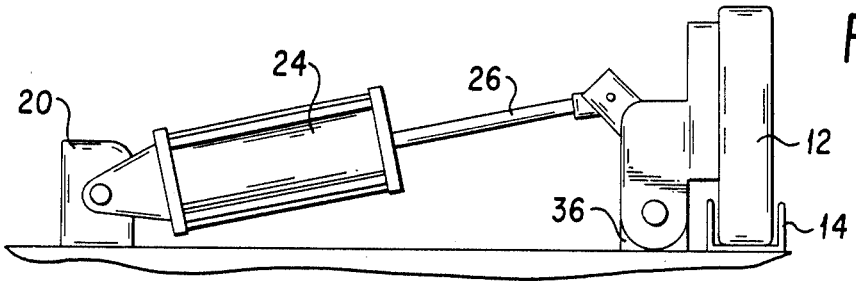
FIG. 3 is a side elevation view of the present locking assembly in the locking position.
Figure 4:
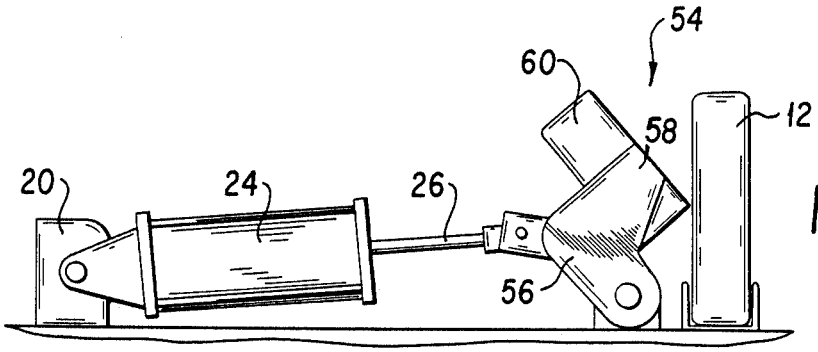
FIG. 4 is a side elevation of the locking assembly of FIG. 3 in the raised or unlocked position.

An alternate embodiment of the wheel brace configuration is shown in FIGS. 3–5. Wheel brace 54 has first and second legs 56 and 58 as well as a third leg 60 inclined in a manner to correspond with the curvature of wheel 12 to facilitate wedging of the wheel brace against wheel 12 during locking for secure support against rolling or rocking.

FIGS. 3 and 5 illustrate the rocker assembly in a locked position. Piston rod 26 is fully extended, and wheel braces 38 and 40 are rotated to a locked position best illustrated in FIG. 5. In the locked position legs 56 and 58 of wheel braces 54 cross over track 14 to prevent rolling of wheels 12. The wheel braces are adapted to contact wheels 12 on inner surfaces of the pair of wheels on one side of the vat as shown in FIG. 5. FIG. 4 illustrates the locking assembly in an open position. The coupling between mounting piece 28 on the end of piston rod 26 and flanges 44 (shown in FIG. 2) defines an obtuse angle (below the coupling) with the horizontal to facilitate rotation to the closed position upon forward motion of the piston rod.

Numerous variations from the specific embodiments discussed are possible within the scope of the present invention. Although a detailed description of the present invention has been provided, it is to be understood that the scope of the invention is not to be limited thereby, but is to be determined from the claims which follow.

What is claimed is:

1. A wheel locking assembly for locking wheels of a vat mounted onto a track said wheels being spaced along said track comprising:

a fluid cylinder having a cylinder portion and piston rod;

a support bar coupled to the piston rod and extending parallel to said track, the support bar being substantially perpendicular to the piston rod;

a wheel brace on each end of the support bar;

a pin affixed to each wheel brace about which the wheel brace pivots;

a surface on each wheel brace transverse to the track and extendable therecross, each wheel brace having at least two sections, at least one section including said surface extending toward the track, and wherein movement of the piston toward the track causes simultaneous movement of each wheel brace into locking position such that each said surface extends transverse of said track between said spaced wheels.

2. A wheel locking assembly according to claim 1 wherein each wheel brace comprises a stepped configuration.

3. A wheel locking assembly according to claim 1 wherein each wheel brace comprises a first flat portion and a second portion which inclines inwardly.

4. A wheel locking assembly in accordance with claim 1 wherein each wheel brace comprises a first flat portion and second portion which inclines outwardly.

5. A wheel locking assembly in accordance with claim 1 wherein the pin affixed to each wheel brace is parallel to the support bar.

6. A wheel locking assembly in accordance with claim 1 wherein the pin affixed to each wheel brace comprises a single pin which is a bar extending parallel to the support bar.

7. A wheel locking assembly according to claim 1 wherein the fluid cylinder is an air cylinder.

* * * * *